US007137575B2

(12) United States Patent
Yoneda

(10) Patent No.: US 7,137,575 B2
(45) Date of Patent: Nov. 21, 2006

(54) FIRE HOSE NOZZLE

(75) Inventor: Toyohiko Yoneda, Kyoto (JP)

(73) Assignee: Yone Corporation, Kyoto (JP)

( * ) Notice: Subject to any disclaimer, the term of this patent is extended or adjusted under 35 U.S.C. 154(b) by 0 days.

(21) Appl. No.: 10/883,756

(22) Filed: Jul. 6, 2004

(65) Prior Publication Data

US 2005/0011971 A1 Jan. 20, 2005

(30) Foreign Application Priority Data

Jul. 18, 2003 (JP) ..... 2003-276690
May 13, 2004 (JP) ..... 2004-143384

(51) Int. Cl.
*B05B 1/26* (2006.01)
*B05B 1/32* (2006.01)
*B67D 5/38* (2006.01)

(52) U.S. Cl. ..... 239/513; 239/514; 239/553; 239/74; 239/456; 239/457; 239/458; 239/523; 239/539

(58) Field of Classification Search ..... 169/14, 169/15; 239/71, 456, 457, 458, 523, 524, 239/513, 514, 538, 539, 541
See application file for complete search history.

(56) References Cited

U.S. PATENT DOCUMENTS 2,871,059 A * 1/1959 O'Brien ..... 239/539
3,012,733 A * 12/1961 Allenbaugh, Jr. ..... 239/458
3,150,829 A * 9/1964 Specht et al. ..... 239/107
3,363,842 A * 1/1968 Burns ..... 239/441
3,494,561 A * 2/1970 Buehler ..... 239/458
3,746,262 A * 7/1973 Bete et al. ..... 239/458
4,095,749 A * 6/1978 Campbell ..... 239/458
RE29,717 E * 8/1978 Thompson ..... 239/107
4,342,426 A * 8/1982 Gagliardo ..... 239/457
6,007,001 A 12/1999 Hilton ..... 239/452
6,561,439 B1 * 5/2003 Bonzer ..... 239/451

FOREIGN PATENT DOCUMENTS

EP 0 927 562 A2 7/1999
FR 2 588 348 4/1987
JP 9-285561 11/1997

* cited by examiner

*Primary Examiner*—David A. Scherbel
*Assistant Examiner*—Seth Barney
(74) *Attorney, Agent, or Firm*—Armstrong, Kratz, Quintos, Hanson & Brooks, LLP

(57) ABSTRACT

A nozzle for use with a fire hose is capable of varying a discharge pattern while maintaining the total water discharge amount at a fixed level. A first tube 4 is connected to a fire hose, a second tube 5 is screwed onto the first tube, and a throttle valve 40 is disposed on the inside of the second tube. A throttled portion 10 between the second tube and the throttle valve maintains the total water discharge amount at a fixed level. The position of the second tube 5 is varied by rotating a grip 42, and thus the total water discharge amount setting is varied. A third tube 13 is screwed onto the second tube, and a fourth tube 14 is screwed onto the third tube. The position of the third tube 13 is varied by rotating a grip 60, and thus the discharge pattern is varied. The position of the fourth tube 14 is varied by rotating a grip 66, and thus the flow rate of a self-protection water spray is regulated. The throttled portion 10 maintains the total water discharge amount at a preset level even when the discharge pattern or the flow rate of the self-protection water spray is varied.

11 Claims, 4 Drawing Sheets

FIRE HOSE NOZZLE

CROSS-REFERENCE TO RELATED APPLICATIONS

This application relates to and claims priority from Japanese Patent Applications No. 2003-276690, filed on Jul. 18, 2003, and No. 2004-143384, filed on May 13, 2004, the entire disclosure of both of which is incorporated herein by reference.

BACKGROUND OF THE INVENTION

1. Field of the Invention

The present invention relates to a nozzle for a fire hose.

2. Description of the Related Art

Conventionally, a fire hose nozzle connected to the tip end portion of a fire hose is provided with a mechanism for varying the pattern in which water is discharged in a plurality of ways. For example, in a fire hose nozzle described in Japanese Unexamined Patent Application Publication H9-285561, a first cylinder is joined screwably by a screw to the outer periphery of the tip end of a fixed nozzle main body which is connected to the tip end portion of a fire hose, and a second cylinder is joined screwably by a screw to the outer periphery of the first cylinder. By rotating the first cylinder such that the first cylinder moves forward or backward along the fixed nozzle main body, the surface area of an inlet to a flow path on the inside of the first cylinder varies, thus varying the flow rate of a rectilinear rod-form water jet that is discharged forward from the inner flow path. By rotating the second cylinder such that the second cylinder moves forward or backward along the first cylinder, the area and form of an outlet from an annular flow path between the first cylinder and second cylinder varies, and thus the form (tubular form and radial form) and flow rate of an atomized water spray that is discharged from the annular flow path is controlled. Hence a selection may be made among a plurality of discharge patterns, consisting of a rod-form discharge pattern in which water is discharged as a linear rod-form water jet, a spray-form discharge pattern in which an atomized water spray is discharged in a tubular or radial form, and a combination discharge pattern combining the rod-form water jet and the atomized water spray.

However, in this conventional fire hose nozzle, when the discharge pattern is varied at a fixed water pressure, the surface area of one or both of the inner flow path inlet and the annular flow path outlet varies, causing the flow resistance to vary, and hence the total water discharge amount (total flow) from the nozzle fluctuates. This causes a problem in that the load acting on a discharge pump fluctuates when the discharge pattern is varied using the fire hose nozzle. The load acting on the firefighter also fluctuates when the discharge pattern is varied using the fire hose nozzle.

Further, in this conventional fire hose nozzle, the first cylinder must be rotated to control the rod-form water jet, and the second cylinder must be rotated to control the atomized water spray. Hence, to choose from among the plurality of discharge patterns described above, the firefighter must operate the two cylinders manually. A simpler method of varying the discharge pattern in a shorter time period is therefore desirable.

Furthermore, in the combination discharge pattern combining the rod-form water jet and the atomized water spray, the atomized water spray that is discharged radially functions to lower the temperature of the flames that are directly in front of the firefighter and block off the smoke, and is therefore used by the firefighter as a self-protection water screen. It is desirable to be able to control the protection capability of this self-protection water spray (for example, the thickness or flow rate of the water screen) according to the situation at the scene of the fire. In the conventional fire hose nozzle described above, however, when the water discharge amount of the atomized water spray is altered, the form of the spray also changes, and hence it is difficult to control the protection capability of the water spray while maintaining the self-protection radial form thereof.

SUMMARY OF THE INVENTION

An object of the present invention is to ensure that in a fire hose nozzle, a total water discharge amount can be maintained at a fixed level even when the discharge pattern is varied at a fixed water pressure.

Another object is to make operations of the fire hose nozzle easier.

A further object is to ensure that the discharge pattern can be varied by operating a single rotary grip.

A further object is to ensure that variation of the discharge pattern and control of the total water discharge amount can be performed independently by operating individual, single-purpose rotary grips.

A further object is to ensure that the protection capability of a self-protection water spray can be controlled.

A further object is to ensure that variation of the discharge pattern, control of the total water discharge amount, and control of the protection capability of the self-protection water spray can be performed independently by operating individual, single-purpose rotary grips.

A fire hose nozzle according to the present invention, which is capable of varying a water pattern, comprises an upstream side tubular assembly connected to a fire hose, for maintaining a total water discharge amount from the nozzle at a preset level, and a downstream side tubular assembly disposed downstream of the upstream side tubular assembly and connected to the upstream side tubular assembly, for varying the discharge pattern. According to this fire hose nozzle, the total water discharge amount is controlled to a preset level by the upstream side tubular assembly disposed upstream of the downstream side tubular assembly even when the discharge pattern is varied in the downstream side tubular assembly.

The upstream side tubular assembly may be constituted to be capable of variably setting a level at which the total water discharge amount which is to be maintained.

In a preferred embodiment, the upstream side tubular assembly comprises a first tube connected to the fire hose, having a first flow path formed on the inside thereof so as to communicate with a flow path on the inside of the fire hose, a second tube attached coaxially to the first tube so as to be capable of axial movement in relation to the first tube, having a front end portion which protrudes forward from the first tube, the inside of the front end portion forming a second flow path which communicates with the first flow path, and a throttle valve provided within the second flow path, for narrowing the cross-sectional area of the second flow path up to a minimum cross-sectional area which determines the total water discharge amount. The minimum cross-sectional area of the second flow path is varied by moving the second tube axially such that the position of the throttle valve relative to the second tube varies. Thus the total water discharge amount can be set variably.

In a preferred embodiment, the second tube is screwed onto the first tube so that by rotating the second tube about the axis, the second tube moves axially in relation to the first tube. A flow rate regulating grip is provided on the outer periphery of the second tube so that by rotating the second tube, the total water discharge amount can be set variably. Furthermore, a ratchet is provided for latching the position of the second tube in each of a plurality of set positions corresponding respectively to a plurality of set water discharge amounts. By rotating the flow rate regulating grip, a firefighter can set the total water discharge amount to a desired set value. The ratchet prevents the flow rate regulating grip from being rotated unintentionally during a fire-extinguishing operation such that the total water discharge amount setting changes.

In a preferred embodiment, the downstream side tubular assembly comprises a third tube attached coaxially to the second tube so as to be capable of moving axially in relation to the second tube, and a fourth tube attached coaxially to the outer periphery of the third tube. The third tube has a front end portion which protrudes forward from the second tube by a protrusion distance which varies according to the axial movement of the third tube, and the inside of the front end portion of the third tube forms a third flow path which communicates with the second flow path. The third flow path takes a form whereby an atomized water spray is discharged when the third tube is in a first position, and a rod-form or tubular water jet is discharged when the third tube is in a second and a third position. A fourth flow path is formed between the third tube and fourth tube. The third tube has a fifth flow path which connects the second flow path to the fourth flow path when the third tube is in the third position. The fourth flow path takes a form whereby a self-protection water spray forming a conical water screen is discharged. As a result of this constitution, a selection can be made by moving the third tube between a spray-form discharge pattern in which a conical atomized water spray is discharged, a rod-form discharge pattern in which a rectilinear rod-form or tubular water jet is discharged, and a combination discharge pattern in which the rectilinear rod-form or tubular water jet and the conical self-protection water spray are discharged simultaneously.

In a preferred embodiment, the third tube is screwed onto the second tube so that by rotating the third tube about the axis, the third tube moves axially in relation to the second tube. Further, a discharge pattern selecting grip is provided on the outer periphery of the third tube so that by rotating the third tube, the discharge pattern can be varied. By rotating the discharge pattern selecting grip, the firefighter is able to vary the discharge pattern.

In a preferred embodiment, the fourth tube is capable of axial movement in relation to the third tube, and the cross-sectional area of the fourth flow path is varied by moving the fourth tube axially in relation to the third tube. Thus the flow rate of the self-protection water spray or the thickness of the water screen is varied. Hence when the combination discharge pattern described above is selected, the protection capability of the self-protection water spray can be regulated by moving the fourth tube.

In a preferred embodiment, the fourth tube is screwed onto the third tube so that by rotating the fourth tube about the axis, the fourth tube moves axially in relation to the third tube. Further, a protection performance regulating grip is provided on the outer periphery of the fourth tube so that by rotating the fourth tube, the flow rate of the self-protection water spray or the thickness of the water screen is varied. Thus when the combination discharge pattern is selected, the firefighter can control the protection capability of the self-protection water spray by rotating the protection performance regulating grip.

DESCRIPTION OF THE PREFERRED EMBODIMENTS

A preferred embodiment of a fire hose nozzle according to the present invention will now be described with reference to the drawings.

Figure 1:
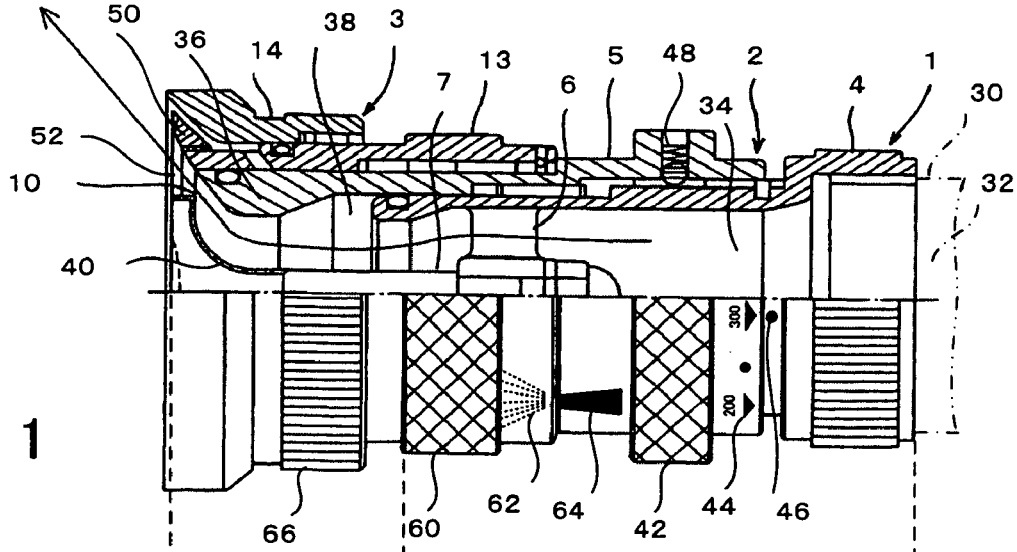
FIG. 1 is a partially cut-away sectional view showing an embodiment of a fire hose nozzle according to the present invention when discharging water in a spray-form discharge pattern.
Figure 2:
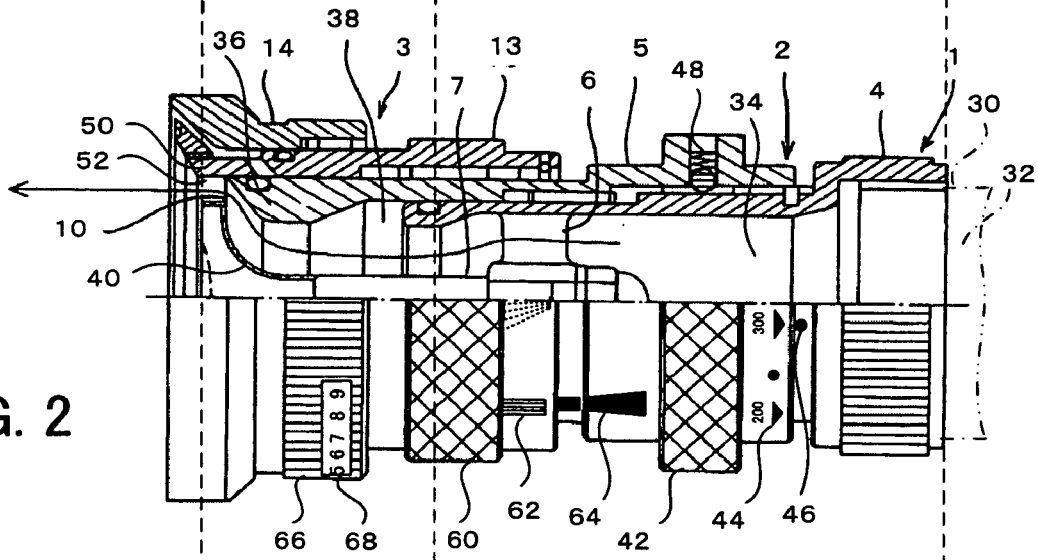
FIG. 2 is a partially cut-away sectional view showing the same embodiment when discharging water in a rod-form discharge pattern.
Figure 3:
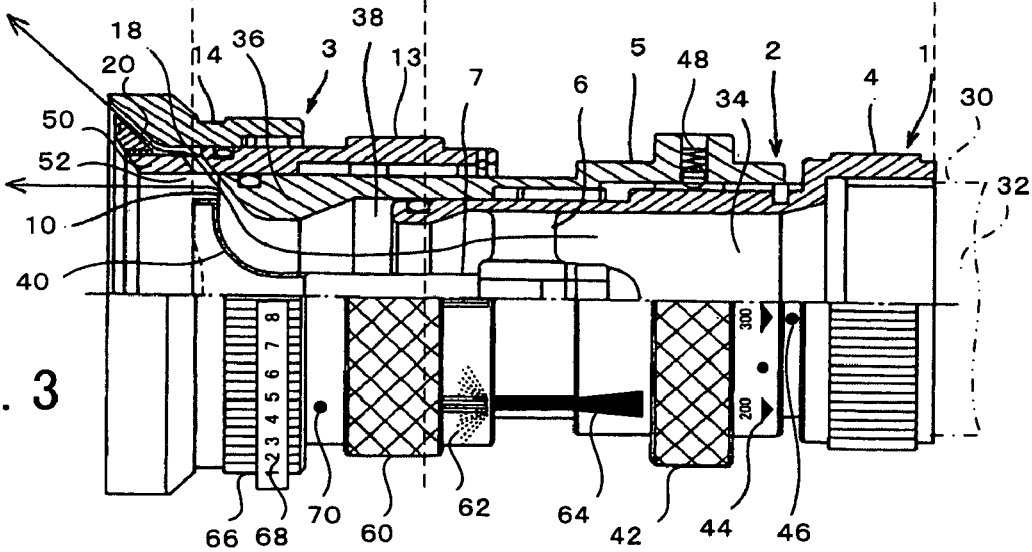
FIG. 3 is a partially cut-away sectional view showing the same embodiment when discharging water in a combination discharge pattern.
Figure 4:
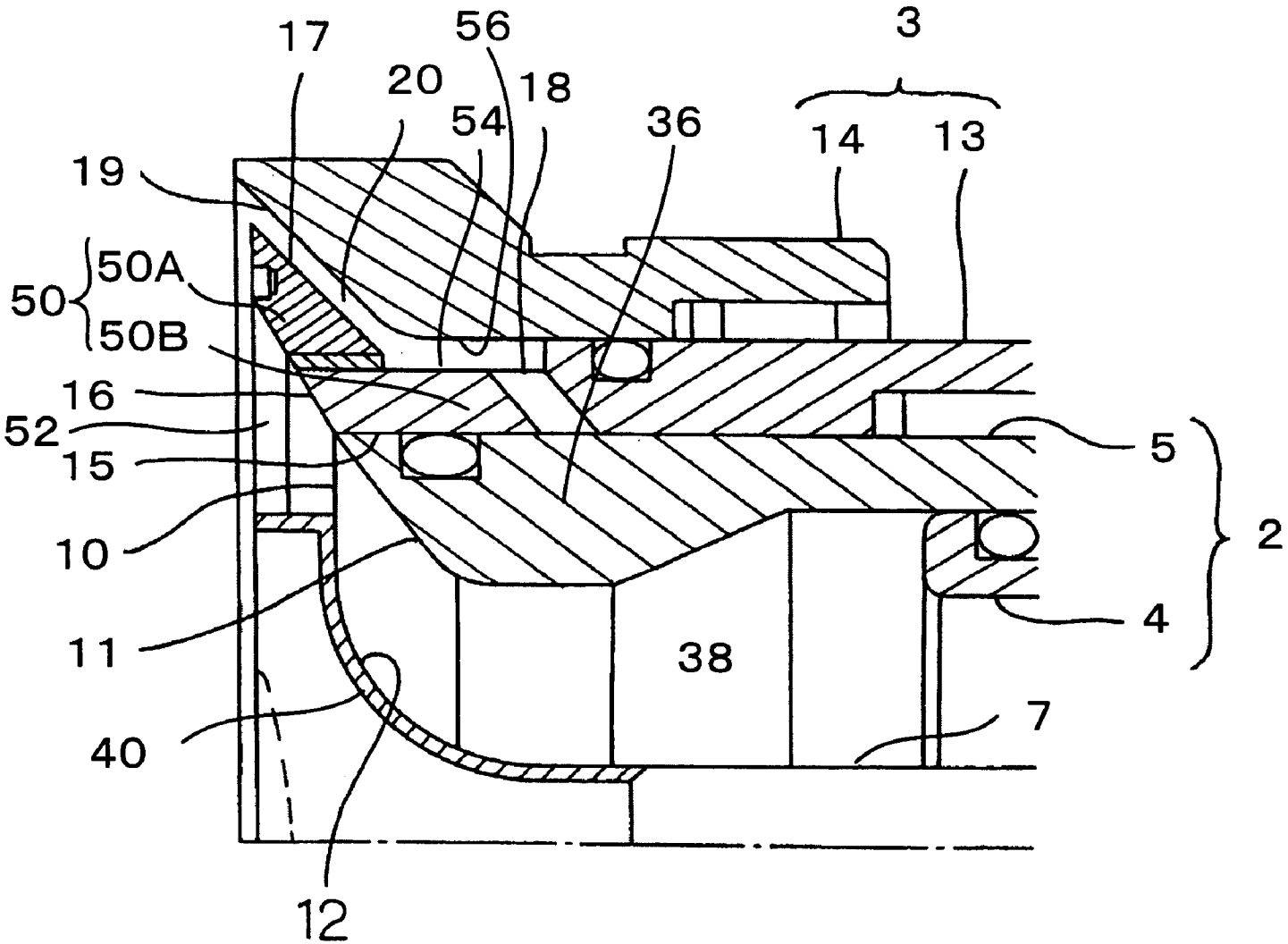
FIG. 4 is an enlarged view showing a tip end portion of the fire hose nozzle of the same embodiment.
Figure 3:
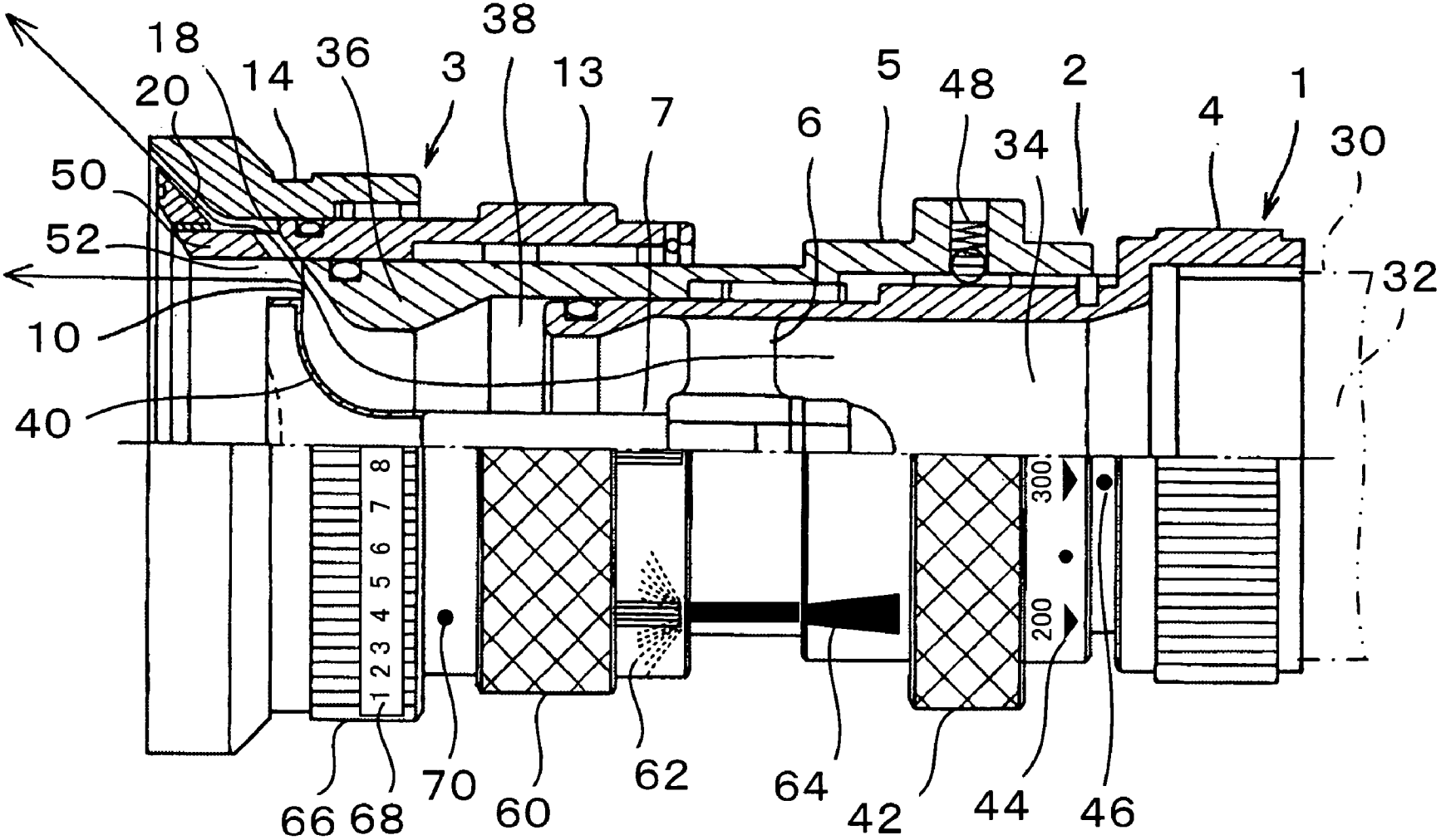
Figure 4:
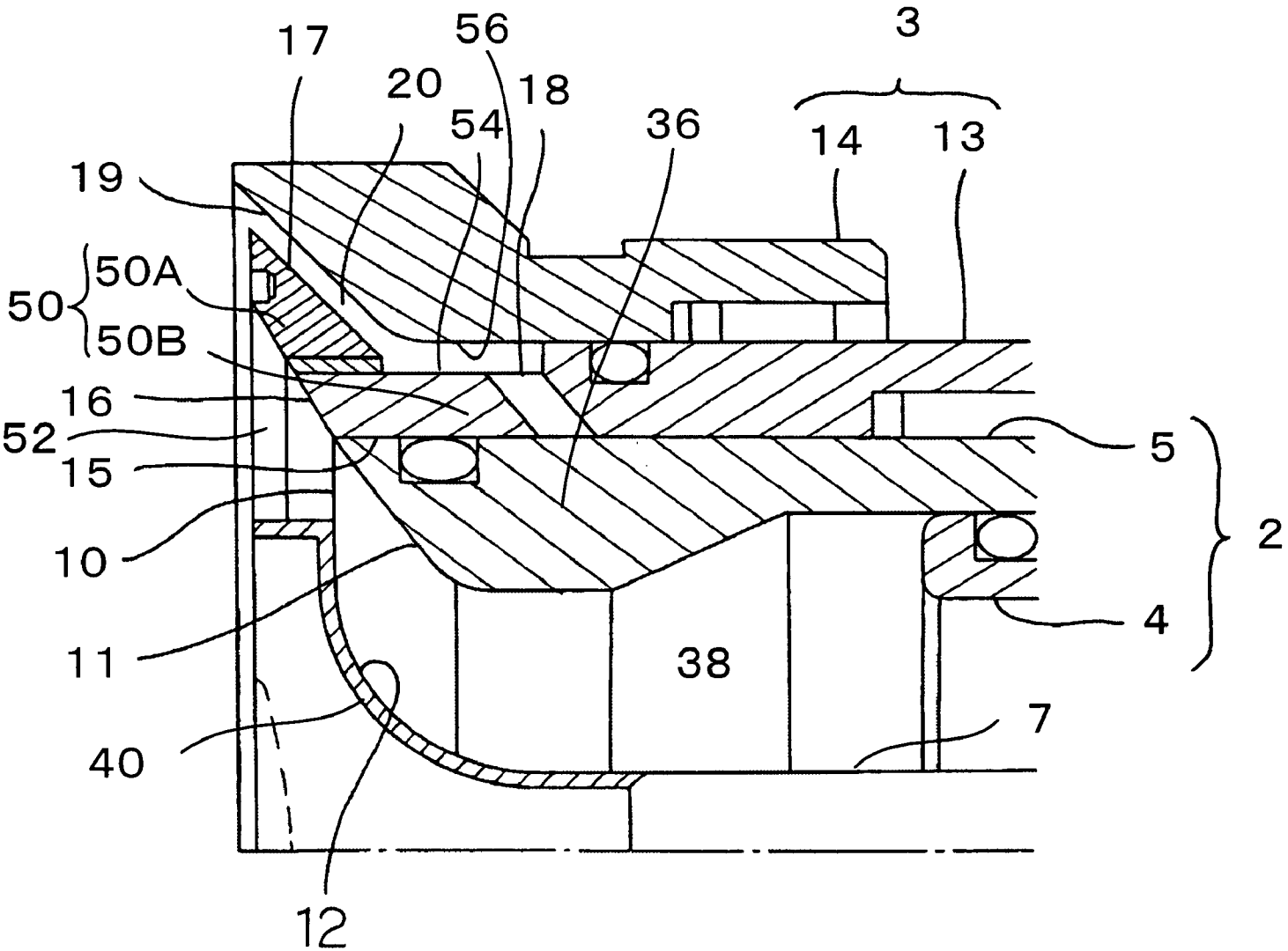

FIGS. 1 through 3 are partially cut-away sectional views showing the fire hose nozzle according to this embodiment when discharging water in a spray-form discharge pattern, a rod-form discharge pattern, and a combination pattern respectively. FIG. 4 is an enlarged view showing a tip end part of the fire hose nozzle.

As shown in FIG. 1, the fire hose nozzle 1 comprises a substantially cylindrical upstream side tubular assembly 2 which is joined to a fire hose 30, and a substantially cylindrical downstream side tubular assembly 3 which is attached to the upstream side tubular assembly 2 so as to be capable of movement in an axial direction. The downstream side tubular assembly 3 is disposed on the down stream side (the left side in the drawing) of the upstream side tubular assembly 2. The upstream side tubular assembly 2 constitutes a mechanism for maintaining the total water discharge amount (total flow) from the fire hose nozzle 1 at a certain set value under a fixed water pressure that is applied from the fire hose 30. The downstream side tubular assembly 3 constitutes a mechanism for varying the discharge pattern.

First, the constitution of the upstream side tubular assembly 2 will be described.

The upstream side tubular assembly 2 comprises a first tube 4 and a second tube 5, both of which are substantially cylindrical. The first tube 4 is connected to the tip end of the fire hose 30, and the interior thereof forms a first flow path 34 which communicates with a flow path 32 inside the fire hose 30. The substantially cylindrical second tube 5 is screwed coaxially onto the outer periphery of the first tube 4. By rotating the second tube 5 about the axis, the second tube 5 is capable of forward (leftward in the drawing) and backward (rightward in the drawing) movements in the axial direction along the first tube 4. The second tube 5 comprises a front end portion 36 which always protrudes forward from the first tube 4. The interior of the front end portion 36 of the second tube 5 forms a second flow path 38 which communicates with the first flow path 34 inside the first tube 4.

A supporting body 6 is provided facing inward in a standing manner on the inner periphery of the first tube 4, and a base end portion of a valve rod 7 is fixed to the supporting body 6. The valve rod 7 is disposed coaxially with the first tube 4. The valve rod 7 comprises a front end portion 40 which protrudes toward the inside of the second flow path 38 in the second tube 5. The front end portion 40 of the valve rod 7 extends from an outlet of the second flow path 38 to a position frontward thereof by a slight distance. The front end portion 40 of the valve rod 7 acts as a throttle valve for gradually narrowing the cross-sectional area of the second flow path 38 in the second tube 5 toward the outlet. More specifically, as is shown clearly in FIG. 4, the inner diameter of the front end portion 36 of the second tube 5 at the part directly before the outlet expands gradually forward to form an inclined surface 11 having a fixed angle of incline when seen in cross section. Further, the outer diameter of the front end portion 40 of the valve rod 7 at the part directly before the outlet expands gradually forward to form an arched surface 12 having an angle of incline which becomes gradually sharper when seen in cross section. Hence the cross-sectional area of the second flow path 38 becomes gradually narrower at the front end portion 40 of the valve rod 7 and the front end portion 36 of the second tube 5, forming a throttled portion 10 having the smallest cross-sectional area at the outlet of the second flow path 38. The cross-sectional area of this throttled portion 10 is smaller than the substantial cross-sectional area of the flow path inside the downstream side tubular assembly 3 positioned downstream thereof. In other words, the cross-sectional area of the throttled portion 10 is the smallest of all the substantial cross-sectional areas along the flow paths inside the fire hose nozzle 1. Accordingly, the throttled portion 10 determines the total water discharge amount (total flow) at a fixed water pressure of the fire hose nozzle 1. By gradually narrowing the cross-sectional area of the second flow path 38 up to the throttled portion 10, resistance acting on the water passing therethrough can be reduced to a minimum, enabling a smooth flow of water.

If the position of the second tube 5 in relation to the first tube 4 is maintained in a fixed position, then the minimum cross-sectional area of the outlet of the second flow path 38 is maintained at a constant level, and hence the total water discharge amount (total flow) is maintained at a fixed level even when the discharge pattern is varied by the downstream side tubular assembly 3 at a fixed water pressure. By rotating the second tube 5 such that the second tube 5 moves along the first tube 4, the relative position of the valve rod (throttle valve) 7 (throttle valve 40) to the second tube 5 changes, causing the minimum cross-sectional area at the outlet of the second flow path 38 to increase, and there by varying the total water discharge amount.

A flow rate regulating grip 42 which is rotated by a firefighter to regulate the total water discharge amount is provided on the outer periphery of the second tube 5. A scale 44 showing a plurality of set flow rates is provided on the surface of the flow rate regulating grip 42. A reference position mark 46 is provided on the outer surface of the first tube 4 in the vicinity of the flow rate regulating grip 42. By rotating the flow rate regulating grip 42 (second tube 5) such that an arbitrary set flow rate on the scale 44 is aligned with the reference position mark 46, the total water discharge amount can be set to the corresponding set flow rate. A ratchet 48 for holding the rotary position of the second tube 5 in each of the set flow rate positions on the scale 44 is provided on the second tube 5. The ratchet 48 enables the firefighter to set the total water discharge amount easily, and also prevents mistakes in which the second tube 5 is rotated unintentionally during a fire-extinguishing operation, causing the total water discharge amount setting to change.

Next, the constitution of the downstream side tubular assembly 3 will be described.

The downstream side tubular assembly 3 comprises a substantially cylindrical third tube 13 which is screwed coaxially onto the outer periphery of the second tube 5, and a substantially cylindrical fourth tube 14 which is screwed coaxially onto the outer periphery of the third tube 13. By rotating the third tube 13 about the axis, the third tube 13 is capable of forward and backward movements in the axial direction along the second tube 5. By rotating the fourth tube 14 about the axis, the fourth tube 14 is capable of forward and backward movements in the axial direction along the third tube 13.

The third tube 13 comprises a front end portion 50 which protrudes forward from the second tube 5 by a protrusion distance which varies according to the axial position of the third tube 13. In FIGS. 1 through 3, the position of the third tube 13 in relation to the second tube 5 is shown in different states. In FIG. 1, the third tube 13 is shown in the foremost position of all the states, and thus here, the protrusion distance of the front end portion 50 is at a minimum. In FIG. 3, the third tube 13 is shown in the rearmost position, and thus here, the protrusion distance of the front end portion 50 is at a maximum. FIG. 2 shows an intermediate state between the states of FIGS. 1 and 3.

As is shown clearly in FIG. 4, a foremost end part 50A of the front end portion 50 of the third tube 13, protruding forward from the second tube 5 in the state shown in FIG. 1, has an inner diameter on the inside thereof which expands gradually forward to form an inclined surface 16 having a fixed angle of incline when seen in cross section, and an outer diameter on the outside thereof which expands gradually forward to form an inclined surface 17 having a fixed angle of incline when seen in cross section. Thus the foremost end part 50A of the third tube 13 forms a conical ring having a diameter which expands frontward. A rear part 50B of the front end portion 50 on the third tube 13, which is positioned rearward of the foremost conical ring 50A, has an inner diameter on the inside thereof which forms a constant level surface 15, and an outer diameter on the outside thereof which forms a constant level surface 54. Thus the rear portion 50B of the front end portion 50 on the third tube 13 forms a rectilinear cylinder. This rectilinear cylindrical part 50B protrudes forward from the second tube 5 in the states shown in FIGS. 2 and 3. A third flow path 52 which communicates with the second flow path 38 inside the second tube 5 is formed between the part of the third tube 13 which protrudes forward from the second tube 5 and the part of the aforementioned valve rod 7 which protrudes forward from the second tube 5.

The fourth tube 14 is attached to the outer periphery of the front end portion 50 on the third tube 13. As is shown clearly in FIG. 4, the fourth tube 14 comprises an inclined surface 19 and a level surface 56 which are respectively parallel to the inclined surface 17 and level surface 54 on the outside of the front end portion 50 on the third tube 13. A fourth flow path 20 surrounded by these surfaces 17, 54, 19, and 56 is formed between the fourth tube 14 and the front end portion 50 of the third tube 13. The cross-sectional area of the fourth flow path 20, and in particular the cross-sectional area of a conical part sandwiched between the inclined surfaces 17 and 19 at the outlet side, varies according to the position of the fourth tube 14 in relation to the third tube 13. Further, a plurality of through holes (fifth flow path) 18, which link the third flow path 52 on the inside of the third tube 13 to the fourth flow path 20 on the outside thereof, are formed in the wall of the front end portion 50 on the third tube 13 at the part which protrudes frontward from the second tube 5 only in the state shown in FIG. 3. The through holes 18 of the fifth flow path are inclined forward toward the outside.

When the third tube 13 is in the rearmost position as shown in FIG. 1, the water that is supplied from the fire hose 30 passes through the second flow path 38, and is discharged diagonally forward along the inclined surface 11 (see FIG. 4) of the front end portion 36 of the second tube 5 and the inclined surface 16 (see FIG. 4) of the foremost end portion 50A of the third tube 13. Thus an atomized water spray is discharged from the fire hose nozzle 1 in a forward radial direction (spray-form discharge pattern).

When the third tube 13 is in an intermediate position as shown in FIG. 2, the water that is supplied from the fire hose 30 passes through the second flow path 38, and is discharged straight ahead along the level surface 15 of the rear portion SOB on the front end portion 50 of the third tube 13. Thus a rod-form or tubular water jet is discharged from the fire hose nozzle 1 straight ahead (rod-form discharge pattern).

When the third tube 13 is positioned even further forward as shown in FIG. 3, the water that is supplied from the fire hose 30 passes through the second flow path 38, whereupon apart of the water is discharged straight ahead along the level surface 15 of the rear portion SOB on the front end portion 50 of the third tube 13, and the remaining part of the water enters the fourth flow path 20 through the fifth flow path 18 to be discharged in a forward radial direction along the front end inclined surfaces 17 and 19 of the fourth flow path 20. Thus a rod-form or tubular water jet is discharged straight ahead from the fire hose nozzle 1 at the same time as a self-protection water spray, which serves as a conical water screen, is discharged in a forward radial direction (combination discharge pattern).

A selection may be made among the three discharge patterns described above by rotating the third tube 13 about the axis such that the third tube 13 moves axially in relation to the second tube 5. A discharge pattern selecting grip 60 which a firefighter rotates to select the discharge pattern is provided on the outer periphery of the third tube 13. Symbol marks 62 corresponding to each of the discharge patterns are displayed on the outer surface of the discharge pattern selecting grip 60. A reference position mark 64 is displayed on the outer surface of the second tube 5 in the vicinity of the discharge pattern selecting grip 60. By rotating the discharge pattern selecting grip 60 such that the symbol mark 62 for an arbitrary discharge pattern is aligned with the reference position mark 64, the corresponding discharge pattern may be selected.

When the combination discharge pattern shown in FIG. 3 is selected, the flow rate of the self-protection water spray, or in other words the thickness of the water screen, can be varied by rotating the fourth tube 14 about the axis such that the fourth tube 14 moves axially relative to the third tube 13, and thus the protection capability against flames or smoke can be regulated. The fourth tube 14 comprises a protection performance regulating grip 66 which is rotated by a firefighter to regulate the protection capability. As shown in FIG. 3, a scale 68 showing various protection performance levels is displayed on the outer surface of the protection performance regulating grip 66. A reference position mark 70 is displayed on the outer surface of the third tube 13 in the vicinity of the protection performance regulating grip 66. By rotating the protection performance regulating grip 66 such that an arbitrary level on the scale 68 is aligned with the reference position mark 70, the flow rate of the self-protection water spray (the thickness of the water screen) can be set at the corresponding level.

When the discharge pattern selecting grip 60 is rotated to change the discharge pattern, or when the protection performance regulating grip 66 is rotated to modify the protection performance of the self-protection water-spray, the total water discharge amount at a fixed water pressure is maintained at a constant level as long as the set water discharge amount is not modified by rotating the water discharge amount regulating grip 42.

As described above, in this fire hose nozzle 1, the set water discharge amount, the discharge pattern, and the protection performance of the self-protection water spray can be controlled independently by the single-purpose water discharge amount regulating grip 42, discharge pattern selecting grip 60, and protection performance regulating grip 66 respectively. To vary the discharge pattern, only the discharge pattern selecting grip 60 need be rotated. When a set water discharge amount is set once using the water discharge amount regulating grip 42, then the total water discharge amount is maintained at a preset level even when the discharge pattern or protection performance is varied, and hence there is little variation in the loads on the fire pump and firefighter. As a result, the fire hose nozzle 1 can be used easily by a firefighter.

An embodiment of the present invention was described above, but this is merely an example for illustrating the present invention, and the technical scope of the present invention is not limited to this embodiment alone. Accordingly, the present invention may be implemented with various specific constitutions that are different to the embodiment described above.

What is claimed is:

1. A fire hose nozzle which is capable of varying a discharge pattern, comprising:

an upstream side tubular assembly for maintaining a total water discharge amount from said nozzle at a preset level, having a first tube connected to a fire hose, a second tube coaxially attached to said first tube, and a throttle valve fixed to said first tube; and a downstream side tubular assembly disposed on the downstream side of said upstream side tubular assembly and connected to said upstream side tubular assembly, for varying the discharge pattern, wherein said second tube and said throttle valve form a throttled portion having a flow path cross-sectional area smaller than a flow path cross-sectional area of said downstream side tubular assembly for every discharge pattern.

2. The fire hose nozzle according to claim 1, wherein said upstream side tubular assembly is capable of variably setting a level at which said total water discharge amount is to be maintained.

3. The fire hose nozzle according to claim 1, wherein said first tube, connected to said fire hose, has a first flow path formed on the inside thereof so as to communicate with a flow path on the inside of said fire hose, wherein said second tube, attached coaxially to said first tube, is capable of axial movement in relation to said first tube, said second tube having a front end portion which protrudes forward from said first tube, the inside of said front end portion forming a second flow path which communicates with said first flow path, and wherein said throttle valve, provided within said second flow path, narrows the cross-sectional area of said second flow path up to a minimum cross-sectional area which determines said total water discharge amount, said minimum cross-sectional area of said second flow path being modified by moving said second tube axially such that the position of said throttle valve relative to said second tube varies, whereby said total water discharge amount can be set variably.

4. The fire hose nozzle according to claim 3, wherein said second tube is coaxially screwed onto said first tube so that by rotating said second tube about the axis, said second tube moves axially in relation to said first tube, and a flow rate regulating grip is provided on the outer periphery of said second tube so that by rotating said second tube, said total water discharge amount can be set variably.

5. The fire hose nozzle according to claim 3 or 4, further comprising a ratchet for latching the position of said second tube in each of a plurality of set positions corresponding respectively to a plurality of set water discharge amounts.

6. A fire hose nozzle which is capable of varying a discharge pattern, comprising:

an upstream side tubular assembly connected to a fire hose, for maintaining a total water discharge amount from said nozzle at a preset level; and a downstream side tubular assembly disposed on the downstream side of said upstream side tubular assembly and connected to said upstream side tubular assembly, for varying the discharge pattern, wherein said upstream side tubular assembly is capable of variably setting a level at which said total water discharge amount is to be maintained, wherein said upstream side tubular assembly comprises:

a first tube connected to said fire hose, having a first flow path formed on the inside thereof so as to communicate with a flow path on the inside of said fire hose, a second tube attached coaxially to said first tube so as to be capable of axial movement in relation to said first tube, having a front end portion which protrudes forward from said first tube, the inside of said front end portion forming a second flow path which communicates with said first flow path, and a throttle valve provided within said second flow path, for narrowing the cross-sectional area of said second flow path up to a minimum cross-sectional area which determines said total water discharge amount, said minimum cross-sectional area of said second flow path being modified by moving said second tube axially such that the position of said throttle valve relative to said second tube varies, whereby said total water discharge amount can be set variably, wherein said downstream side tubular assembly comprises:

a third tube attached coaxially to said second tube so as to be capable of moving axially in relation to said second tube, and a fourth tube attached coaxially to the outer periphery of said third tube, said third tube having a front end portion which protrudes forward from said second tube by a protrusion distance which varies according to the axial movement of said third tube, the inside of the front end portion of said third tube forming a third flow path which communicates with said second flow path, said third flow path taking a form whereby an atomized water spray is discharged when said third tube is in a first position, and a rod-form or tubular waterjet is discharged when said third tube is in a second and a third position, a fourth flow path being formed between said third tube and said fourth tube, said third tube having a fifth flow path which connects said second flow path to said fourth flow path when said third tube is in said third position, and said fourth flow path taking a form whereby a self-protection water spray which forms a conical water screen is discharged.

7. The fire hose nozzle according to claim 6, wherein said third tube is screwed onto said second tube so that by rotating said third tube about the axis, said third tube moves axially in relation to said second tube, and a discharge pattern selecting grip is provided on the outer periphery of said third tube so that by rotating said third tube, said discharge pattern is varied.

8. The fire hose nozzle according to claim 6, wherein said fourth tube is capable of axial movement in relation to said third tube, the cross-sectional area of said fourth flow path being varied by moving said fourth tube axially in relation to said third tube, whereby the thickness of the water screen forming said self-protection water spray is varied.

9. The fire hose nozzle according to claim 6, wherein said fourth tube is screwed onto said third tube so that by rotating said fourth tube about the axis, said fourth tube moves axially in relation to said third tube, the cross-sectional area of said fourth flow path is varied by moving said fourth tube axially in relation to said third tube, whereby the flow rate of said self-protection water spray or the thickness of said water screen is varied, and a protection performance regulating grip is provided on the outer periphery of said fourth tube so that by rotating said fourth tube, the flow rate of said self-protection water spray or the thickness of said water screen is varied.

10. The fire hose nozzle according to claim 6, wherein said second tube is screwed onto said first tube so that by rotating said second tube about the axis, said second tube moves axially in relation to said first tube, and a flow rate regulating grip is provided on the outer periphery of said second tube so that by rotating said second tube, said total water discharge amount can be set variably.

11. A fire hose nozzle which is capable of varying a discharge pattern, comprising:

an upstream side tubular assembly connected to a fire hose, for maintaining a total water discharge amount from said nozzle at a preset level; and a downstream side tubular assembly disposed on the downstream side of said upstream side tubular assembly and connected to said upstream side tubular assembly, for varying the discharge pattern, wherein said upstream side tubular assembly has a flow path formed on the inside thereof to communicate with a flow path on the inside of said fire hose, and wherein said upstream side tubular assembly maintains a cross-section area of a flow path thereof at a smaller cross-section area than a cross-section area of a flow path of said downstream side tubular assembly, so as to maintain a constant level water discharge amount even when the discharge pattern is varied by the downstream side tubular assembly.

* * * * *